US009528329B2

(12) United States Patent
Pallini, Jr.

(10) Patent No.: US 9,528,329 B2
(45) Date of Patent: Dec. 27, 2016

(54) MARINE RISER TENSIONER WITH LOAD TRANSFERRING CENTRALIZATION

(71) Applicant: Vetco Gray Inc., Houston, TX (US)

(72) Inventor: Joseph William Pallini, Jr., Houston, TX (US)

(73) Assignee: Vetco Gray Inc., Houston, TX (US)

( * ) Notice: Subject to any disclaimer, the term of this patent is extended or adjusted under 35 U.S.C. 154(b) by 0 days.

(21) Appl. No.: 14/313,387

(22) Filed: Jun. 24, 2014

(65) Prior Publication Data

US 2015/0368992 A1 Dec. 24, 2015

(51) Int. Cl.
*E21B 19/00* (2006.01)

(52) U.S. Cl.
CPC ..... *E21B 19/006* (2013.01); *E21B 19/002* (2013.01)

(58) Field of Classification Search
CPC ..... E21B 19/002; E21B 19/006; E21B 17/015
USPC ..... 405/224.4
See application file for complete search history.

(56) References Cited

U.S. PATENT DOCUMENTS 4,379,657 A * 4/1983 Widiner et al. ..... 405/224.4
4,808,035 A 2/1989 Stanton et al.
4,934,870 A 6/1990 Petty et al.
5,427,180 A * 6/1995 dePaiva Leite et al. ..... 166/355
5,551,803 A * 9/1996 Pallini et al. ..... 405/223.1
5,794,700 A * 8/1998 Pollack ..... 166/339
7,270,071 B1 * 9/2007 Shivers et al. ..... 114/265
7,329,070 B1 * 2/2008 Trent et al. ..... 405/224.4
8,021,081 B2 * 9/2011 Crotwell et al. ..... 405/223.1
8,496,409 B2 7/2013 Aksel et al.
8,579,034 B2 * 11/2013 Berner et al. ..... 166/355
2009/0145611 A1 * 6/2009 Pallini et al. ..... 166/355
2012/0207550 A1 * 8/2012 Aksel et al. ..... 405/224.4
2013/0115012 A1 5/2013 Aksel et al.
2014/0010597 A1 * 1/2014 Otten et al. ..... 405/224.4

OTHER PUBLICATIONS

PCT Search Report and Written Opinion issued in connection with corresponding PCT Application No. PCT/US2015/034995 on Dec. 23, 2015.

* cited by examiner

*Primary Examiner* — Tara M. Pinnock
(74) *Attorney, Agent, or Firm* — Hogan Lovells US LLP

(57) ABSTRACT

A tensioner for maintaining a tensile force in a riser extending from a subsea wellhead assembly to a deck of a floating platform includes a hydro-pneumatic assembly having a first section secured to the deck and a second section secured to a support frame. A pivot joint is coupled to the riser and to the support frame, so that the riser is retained axially static with respect to the support frame and is pivotable with respect to the support frame. A guide assembly has at least two guide elements, the guide elements being axially spaced from each other so that when the deck and the support frame move axially relative to each other, the guide assembly restricts relative rotational movement between the deck and the support frame.

15 Claims, 5 Drawing Sheets

MARINE RISER TENSIONER WITH LOAD TRANSFERRING CENTRALIZATION

BACKGROUND OF THE DISCLOSURE

1. Field of the Disclosure

The present disclosure relates in general to marine riser tensioners and, in particular, to a push up tensioner assembly that accommodates riser tilt.

2. Brief Description of Related Art

Offshore production platforms must support production risers from oil or gas wells that extend to the platform from subsea wells. For subsea completions in deep water that require the use of floating platforms, such as tension leg platforms (TLPs) or semi-submersible platforms, supporting risers presents significant problems. In TLPs, tension legs extend from the platform down to an anchor located at the sea floor. The tension legs are relatively inelastic, meaning that much of the vertical motion of the platform is eliminated. TLPs allow for location of the wellhead assembly on the surface rather than on the sea floor. A riser will typically extend from the wellhead assembly down to the sea floor. This setup allows for simpler well completion and better control of production. However, in TLPs the riser may tilt from the vertical relative to the TLP. The amount of riser tilt from the vertical is not static and varies with time during operation.

Because floating platforms move under the influence of waves, wind, and current and are subjected to various forces, the riser tensioning mechanism is typically designed to permit the platform to move relative to the riser. The riser tensioning mechanism also usually maintains the riser in tension so that the entire weight of the riser is not transferred to the wellhead, and the riser does not collapse under its own weight. The tensioning mechanism therefore exerts a continuous tensional force on the riser that is maintained within a narrow tolerance.

Push up tensioners generally have operational, reliability, and safety advantages over conventional pull-up tensioning systems. For example, a push up tensioner accommodates higher loads in a smaller space over other types of tensioners. This is in part because push up tensioners use a more efficient piston end and do not require a tension pulling device at the end connection. In addition, use of a push-up tensioner can minimize the corrosive effects of the salt-water environment in which they operate. This is because the high pressure seals of the push-up tensioner are not located adjacent to the atmosphere and are isolated from caustic fluids and debris.

However, for TLP applications, where low loads and stroke lengths are combined with the need to accommodate angular offset of the riser, the current style of push-up tensioner has a cost premium relative to the conventional pull-up system. Current push up systems become relatively economical when stroke range approaches or exceed about 10 ft., or production riser loads exceed about 1000 kips. Current TLP push-up tensioners typically include hydro-pneumatic assemblies that are mounted at an inwardly tilted angle from the deck into a tension load ring. The connection of the cylinder to the deck and load ring often requires a costly mounting system that allows angular offset between the cylinder and deck/load ring. While this configuration works well for TLP riser systems that require high loads and stroke lengths, a large portion of the cost of the system is due to the mounting system and such cost is substantially similar for all such systems, no matter what the stroke length or load requirement might be. Therefore for low stroke length or load requirements, current push up systems are not cost competitive compared to more conventional tensioner systems.

SUMMARY OF THE DISCLOSURE

Systems and methods of the embodiments of the current disclosure provide a configuration for a push up type riser tensioner that is relatively economical for TLP applications having more common load and stroke ranges. Embodiments of this disclosure provide the technical advantages of the push up type tensioner system such as the convenience of having all operations above deck and from a platform that moves with the tensioner and easier quick connection to the riser. The critical surfaces are up high away from the splash zone. The push up type tensioner system of embodiments of this disclosure uses a more efficient piston end and does not require a tension pulling device at the end connection, in contrast to the pull up type system. In addition, the pressure in embodiments of the push up type tensioner does not act on the rod side of the cylinder. Gas and debris tend to move away from seals on the piston instead of on them.

In accordance with an embodiment of the present disclosure, a tensioner for maintaining a tensile force in a riser extending from a subsea wellhead assembly to a deck of a floating platform includes a hydro-pneumatic assembly having a first section secured to the deck and a second section secured to a support frame. The support frame has a central axis. A pivot joint couples the riser to the support frame, preventing relative translational movement between the riser and the support frame. A guide assembly has at least two guide elements, the guide elements being axially spaced from each other so that when the deck and the support frame move axially relative to each other, the guide assembly restricts relative rotational movement between the deck and the support frame.

In accordance with an alternate embodiment of the present disclosure, a tensioner for maintaining a tensile force in a riser extending from a subsea wellhead assembly to a deck of a floating platform includes a support frame with a central axis spaced axially above, and generally parallel to, the deck. A hydro-pneumatic assembly has a first section secured to the deck and a second section secured to the support frame. The hydro-pneumatic assembly urges the support frame away from the deck. A pivot joint is coupled to the riser and to the support frame so that the riser is retained axially static with respect to the support frame and is pivotable with respect to the support frame. A guide assembly has at least two guide elements, the guide elements being axially spaced from each other so that when the deck and the support frame move axially relative to each other, the guide assembly restricts relative rotational movement between the deck and the support frame and the support frame remains in a plane that is substantially parallel with the deck.

In another alternate embodiment of this disclosure, a method for tensioning a riser extending to a deck of a platform includes securing a first section of a hydro-pneumatic assembly to the deck proximate to an opening in the deck. A second section of the hydro-pneumatic assembly is secured to a support frame. The riser is coupled to the support frame with a pivot joint so that the riser and support frame move together in an axial direction and are pivotable with respect to one another. A guide assembly is used to provide relative axial movement between the support frame and the deck and to retain the support frame in a generally parallel orientation with the deck.

BRIEF DESCRIPTION OF THE DRAWINGS

So that the manner in which the features, advantages and objects of the disclosure, as well as others which will become apparent, are attained, and can be understood in more detail, more particular description of the disclosure briefly summarized above may be had by reference to the embodiments thereof which are illustrated in the appended drawings that form a part of this specification. It is to be noted, however, that the drawings illustrate only a preferred embodiment of the disclosure and are therefore not to be considered limiting of its scope as the disclosure may admit to other equally effective embodiments.

DETAILED DESCRIPTION OF THE PREFERRED EMBODIMENT

The present disclosure will now be described more fully hereinafter with reference to the accompanying drawings which illustrate embodiments of the disclosure. This disclosure may, however, be embodied in many different forms and should not be construed as limited to the illustrated embodiments set forth herein. Rather, these embodiments are provided so that this disclosure will be thorough and complete, and will fully convey the scope of the disclosure to those skilled in the art. Like numbers refer to like elements throughout, and the prime notation, if used, indicates similar elements in alternative embodiments.

In the following discussion, numerous specific details are set forth to provide a thorough understanding of the present disclosure. However, it will be obvious to those skilled in the art that the present disclosure may be practiced without such specific details. Additionally, for the most part, details concerning well drilling, running operations, and the like have been omitted in as much as such details are not considered necessary to obtain a complete understanding of the present disclosure, and are considered to be within the skills of persons skilled in the relevant art.

Figure 1:
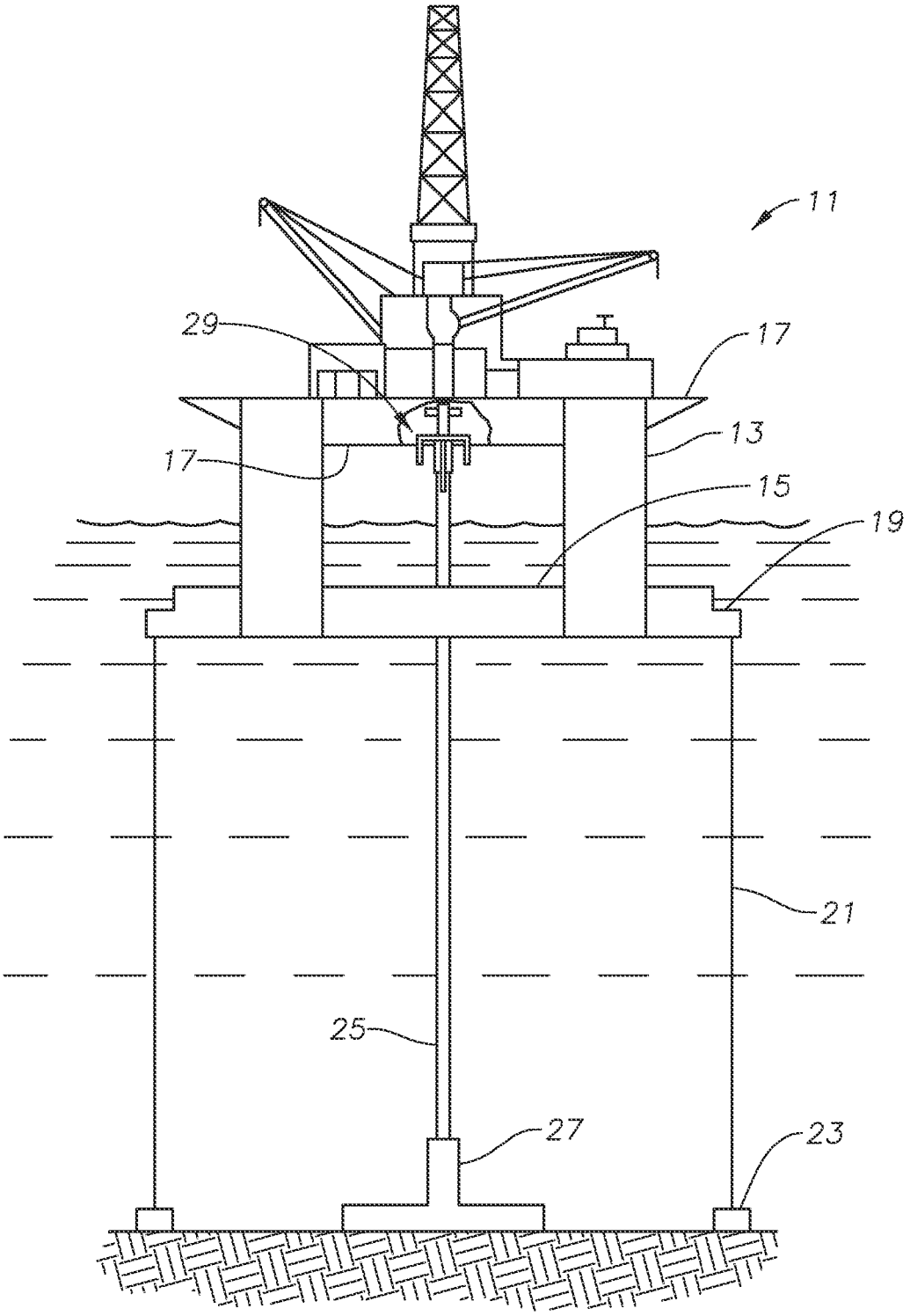
FIG. 1 is a schematic view of a floating platform having a marine riser tensioner assembly in accordance with an embodiment of the present disclosure.

Referring to FIG. 1, floating platform 11 may be of a variety of types with various configurations. In the embodiment of FIG. 1, platform 11 is a tension leg platform having a plurality of columns 13. Floating platform 11 is shown with four vertical columns 13, one at each corner, but different numbers could be used, such as three vertical columns. Horizontal pontoons 15 extend between columns 13. Columns 13 and horizontal pontoons 15 are hollow to provide buoyancy, and are adapted to be selectively ballasted with seawater. Platform 11 has one or more decks 17 for supporting a variety of equipment for offshore drilling and production.

Upper tendon supports 19 are mounted to floating platform 11 at each corner. In this embodiment, each upper tendon support 19 is located on an end of one of the horizontal pontoons 15. Normally, four elongate tendons 21 have upper ends supported at each tendon support 19. Platform 11 with four corners would have eight to sixteen separate tendons 21. The lower end of each tendon 21 is secured to a piling 23 shown set on the seafloor. A riser 25 is shown extending from a subsea wellhead 27 through an opening in one of the decks 17 of the floating platform 11. Riser 25 has a riser axis 24 (FIG. 2) and can be a production riser with a production tree 26 located at the upper end of riser 25 for controlling well fluid flowing upward from riser 25. Alternately, riser 25 may be a drilling riser through which a drill string extends for drilling a well. If surface Christmas trees are employed, a number of production risers 25 can extend parallel to each other from the sea floor to floating platform 11, each riser 25 being connected to a separate wellhead. Alternately, subsea trees could be employed.

Although moored, floating platform 11 will move relative to riser 25 in response to sea current and wave motion. Looking now at FIGS. 1-8, riser tensioner assembly 29 is located on one of the decks 17 and provides tension to riser 25 throughout the movement of floating platform 11. Riser tensioner assembly 29 includes at least one hydro-pneumatic assembly 31. In an example, each hydro-pneumatic assembly 31 is supplied with hydraulic fluid and gas under pressure to provide an upward force to riser 25 to maintain a tension in riser 25 as deck 17 of floating platform 11 moves relative to riser 25. Examples exist wherein the tension in riser 25 is uniformly maintained over time. The gas acts as a spring when the hydro-pneumatic assembly 31 is compressed. A small amount of fluid is used for lubrication of seals within the hydro-pneumatic assembly 31. In the embodiment of FIGS. 1-8, four hydro-pneumatic assemblies 31 are shown, one at each corner of support frame 33. A person skilled in the art will understand that as few as one individual hydro-pneumatic assembly 31 or more than four hydro-pneumatic assemblies 31 may be used.

Each hydro-pneumatic assembly 31 includes a first section and a second section: piston cylinder 35 and piston rod 37. Piston cylinder 35 can be a generally cylindrical member with a central bore that is open at one end for reciprocally receiving piston rod 37. Piston rod 37 can be an elongated cylindrical member that moves into and out of the central bore of piston cylinder 35.

In embodiments of this disclosure either piston cylinder 35 or piston rod 37 can be referred to as the first section and the other of the piston cylinder 35 or piston rod 37 can be referred to as the second section. In the illustrated examples, the first section of hydro-pneumatic assembly 31 is secured to deck 17 proximate to the opening through deck 17, and the second section of hydro-pneumatic assembly 31 is secured to support frame 33 such that hydro-pneumatic assembly 31 applies a generally upward force on support frame 33, urging support frame 33 away from deck 17 in a direction along central axis 39 of support frame 33. In an example, support frame 33 moves with respect to deck 17, but remains in a plane that is substantially parallel with a plane in which deck 17 is in.

Looking at FIGS. 2-3, 5-6, the first section of hydro-pneumatic assembly 31 secured to deck 17 is piston cylinder 35. Piston cylinder 35 extends downward from deck 17. The second section of hydro-pneumatic assembly 31 secured to support frame 33 is piston rod 37. Piston rod 37 extends downward from support frame 33 and moves into and out of the central bore of piston cylinder 35. Looking now at the embodiment of FIGS. 7-8, the first section of hydro-pneumatic assembly 31 secured to deck 17 is piston rod 37, and the second section of hydro-pneumatic assembly 31 secured to support frame 33 is piston cylinder 35. Piston cylinder 35 extends upward from support frame 33. Piston rod 37 extends upward from deck 17 and moves into and out of the central bore of piston cylinder 35. The embodiments of FIGS. 2-3, 5-8 are examples only and other configurations for locating piston cylinder 35 and piston rod 37 are possible, as would be understood by those with ordinary skill in the art.

Figure 3:
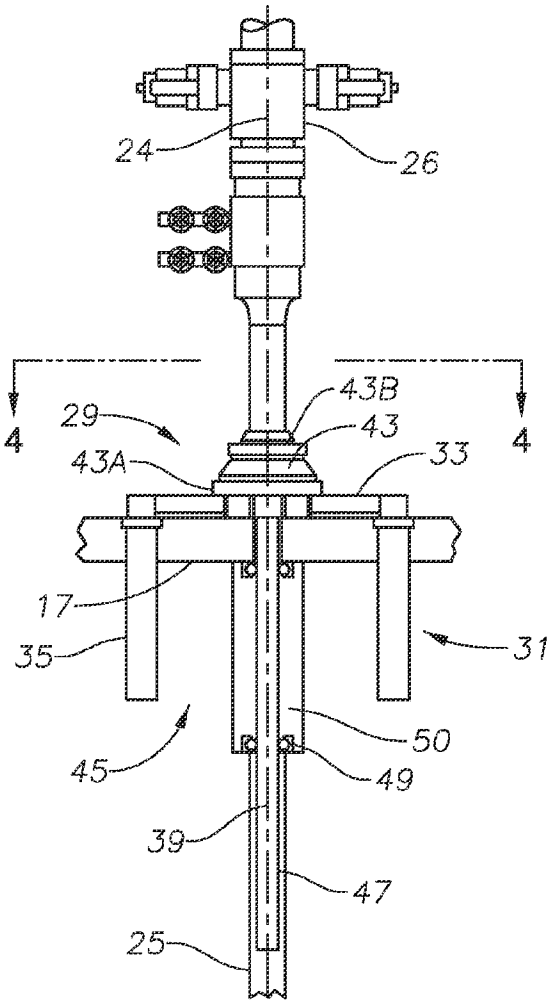
FIG. 3 is an elevation view of the riser tensioner assembly of FIG. 2, with the support frame shown in a lowered position and the riser shown in a vertical position.
Figure 6:
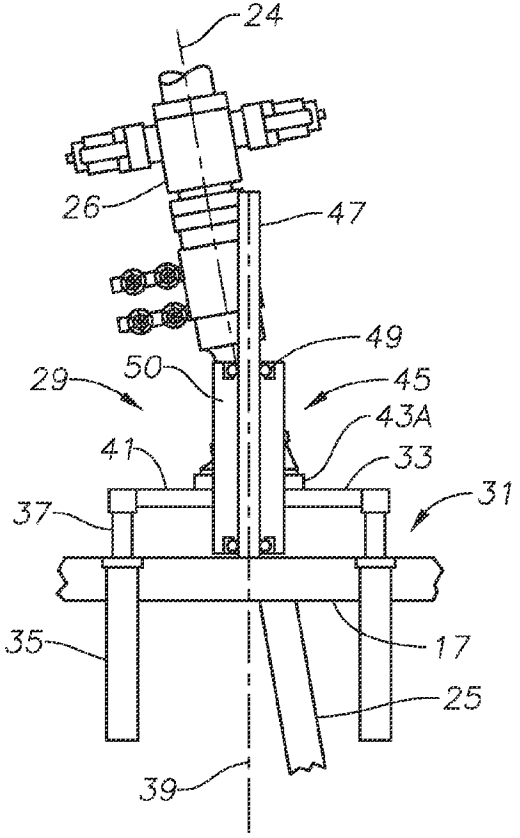
FIG. 6 is an elevation view of the riser tensioner assembly of FIG. 5, with the support frame shown in a lowered position and the riser shown in an angled position.
Figure 8:
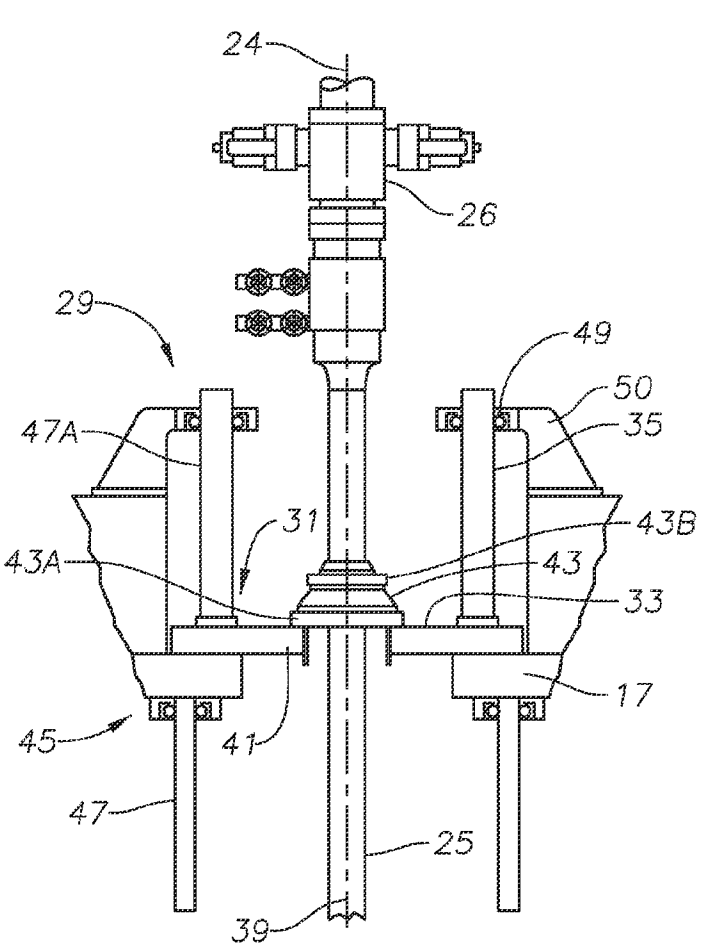
FIG. 8 is an elevation view of the riser tensioner assembly of FIG. 7, with the support frame shown in a lowered position and the riser shown in a vertical position.

Support frame 33 of riser tensioner assembly 29 is located axially above deck 17. Support frame 33 includes a number of elongated structural members 41 that together support the weight and tension load of riser 25. Looking at FIG. 4, certain of the elongated structural members 41 of support frame 33 combine to define a generally square frame centered along central axis 39 (FIG. 3) and in a plane that is generally parallel to deck 17. Certain other of the elongated structural members 41 can be cross pieces, each oriented generally parallel with deck 17, having one end at a corner of support frame 33 and extending towards central axis 39. Support frame 33 is moveable between a raised position where support frame 33 is spaced away from deck 17 (FIGS. 2, 5, 7), and a lowered position where support frame 33 is proximate to deck 17 (FIGS. 3, 6, 8). In the raised position, the lowered position, and in all positions between the raised position and lowered position, support frame 33 is generally parallel to deck 17.

Riser tensioner assembly 29 further includes pivot joint 43, which is supported by support frame 33 and centered at central axis 39. Pivot joint 43 is a rotating connector that transfers loads between riser 25 and support frame 33. Pivot joint 43 couples riser 25 to support frame 33, preventing relative translational movement between riser 25 and support frame 33. Pivot joint 43 prevents riser 25 from moving radially or axially relative to support frame 33 but does, however, allow riser 25 to undergo an angular offset relative to support frame 33 so that riser axis 24 is tilted from the vertical or otherwise angled relative to central axis 39. Therefore, riser 25 is retained axially static with respect to support frame 33 and is pivotable with respect to support frame 33. A static portion 43A of pivot joint 43 is secured to support frame 33 and a rotating portion 43B of pivot joint 43 is secured to riser 25. Static portion 43A is engaged with rotating portion 43B so that static portion 43A and rotating portion 43B are able to rotate relative to each other; such rotation not being about riser axis 24, but rotating in a way that riser axis 24 becomes angled relative to central axis 39. Pivot joint 43 is shown in the embodiments of this disclosure as an elastomeric flex element with an elastomeric cuff that joins static portion 43A and rotating portion 43B. In alternate embodiments, pivot joint 43 can be, for example, a trunnion arrangement, a spherical ball and socket type joint, or other known means with similar capabilities. As floating platform 11 moves due to wave, wind, sea current, or other action, pivot joint 43 can accommodate resulting angular offset between riser 25 and support frame 33.

The axial offset between riser 25 and support frame 33 can be guided by guide assembly 45 of riser tensioner assembly 29. Guide assembly 45 includes at least one guide rod 47, and at least two guide elements 49. Guide elements 49 are axially spaced from each other. Guide element 49 can be, for example, guide rollers that are attached to a guide element support 50. Each guide element 49 can include a number of guide rollers that are positioned around an outer diameter of guide rod 47. Guide rod 47 can move axially along the guide rollers. As will be further discussed below guide assembly 45 includes both a deck section that is coupled to deck 17 and a frame section that is coupled to support frame 33. For example, guide rod 47 can be attached to either support frame 33 or deck 17 and guide element support 50 with guide elements 49 can be attached to the other of support frame 33 or deck 17. In alternate embodiments, guide elements 49 can be sleeve assemblies that circumscribe guide rod 47, bearing assemblies that engage guide rod 47, or other known means for guiding the movement of guide rod 47 in an axial direction.

Guide assembly 45 allows relative axial movement between support frame 33 and deck 17 and limits non-axial relative movement between support frame 33 and deck 17. Guide assembly 45 additionally provides lateral support for support frame 33 relative to deck 17. When riser 25 rotates relative to deck 17 so that there is an angular offset between riser 25 and support frame 33, because guide elements 49 are spaced axially apart and allow only relative axial movement between support frame 33 and deck 17, guide elements 49 will resist relative rotational movement as well as lateral movement between support frame 33 and deck 17. The greater the axial separation between guide elements 49, the better guide elements 49 will be able to resist the bending moment on guide assembly 45. In this manner, each hydro-pneumatic assembly 31 can perform its function of maintaining tension on riser 25 without being subjected to external lateral forces or external bending forces and moments.

Figure 2:
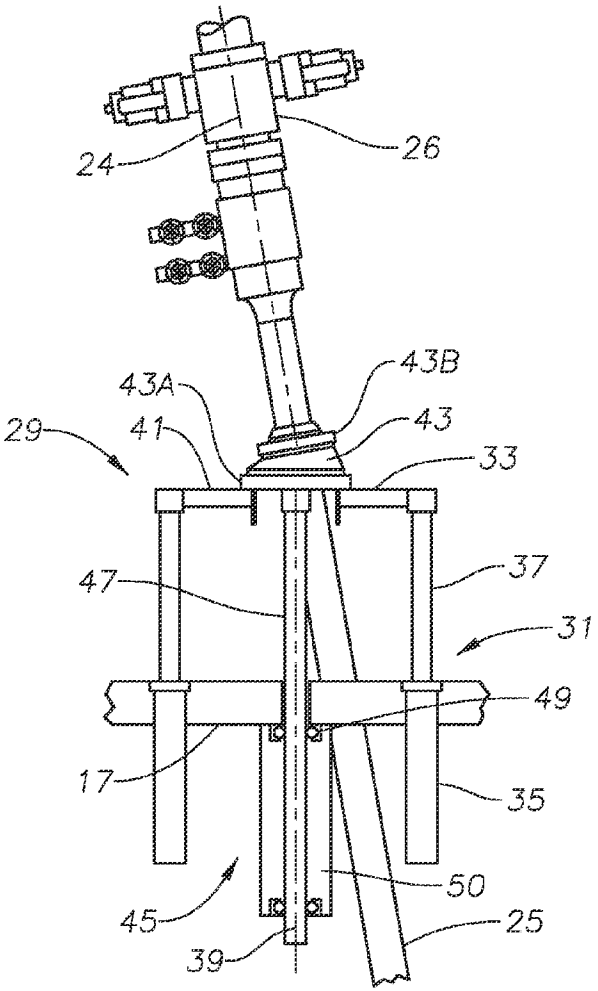
FIG. 2 is an elevation view of a riser tensioner assembly in accordance with an embodiment of the present disclosure, with the support frame shown in a raised position and the riser shown in an angled position.
Figure 4:
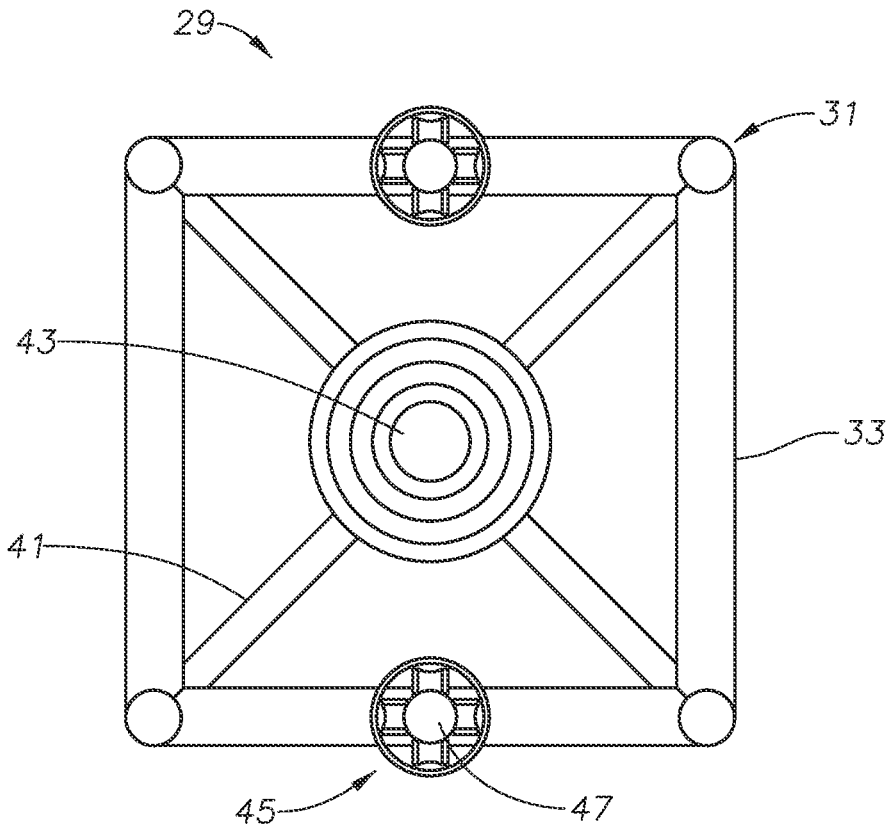
FIG. 4 a top plan view of the riser tensioner assembly of FIG. 3.

In the embodiment of FIGS. 2-4, tensioner assembly 29 includes two guide assemblies 45, located at opposite sides of support frame 33. In alternate embodiments, one guide assembly 45 can be used or more than two guide assemblies 45 can be used. Guide rod 47 is secured to a lower side and extends downward from support frame 33. Guide element support 50 with guide elements 49 is secured to a lower side of, and extends downward from, deck 17. As support frame 33 moves between raised positions and lowered positions, guide rod 47 moves with support frame 33 and guide elements 49 roll along guide rod 47 so that the axial alignment between support frame 33 and deck 17 is maintained and support frame 33 remains generally parallel to deck 17.

Figure 5:
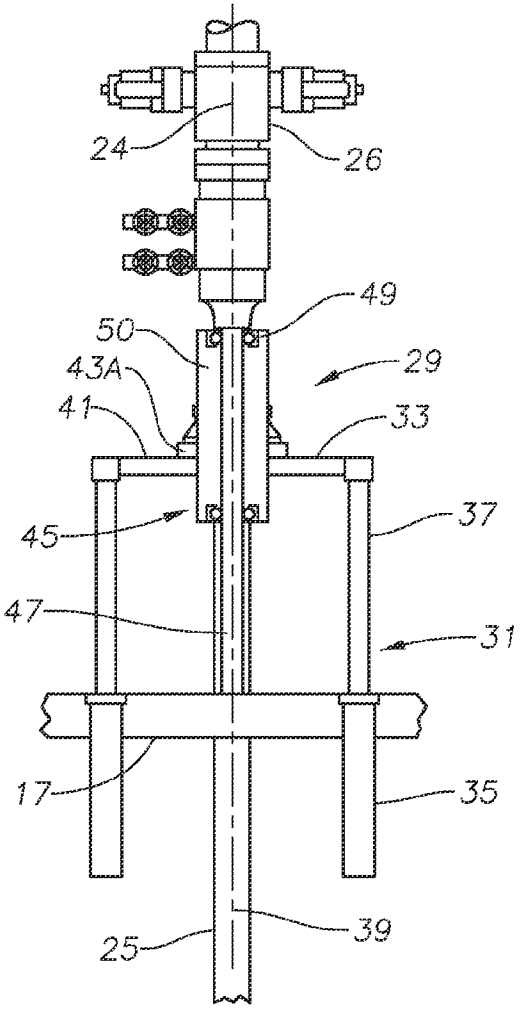
FIG. 5 is an elevation view of a riser tensioner assembly in accordance with another embodiment of the present disclosure, with the support frame shown in a raised position and the riser shown in a vertical position.

In the embodiment of FIGS. 5-6, guide rod 47 is instead secured to an upper side and extends upwards from deck 17. Guide element support 50 with guide elements 49 is secured to support frame 33 and extends both above and below support frame 33. In such an embodiment, as support frame 33 moves between raised positions and lowered positions, guide elements 49 move axially with support frame 33 and roll along guide rod 47.

Figure 7:
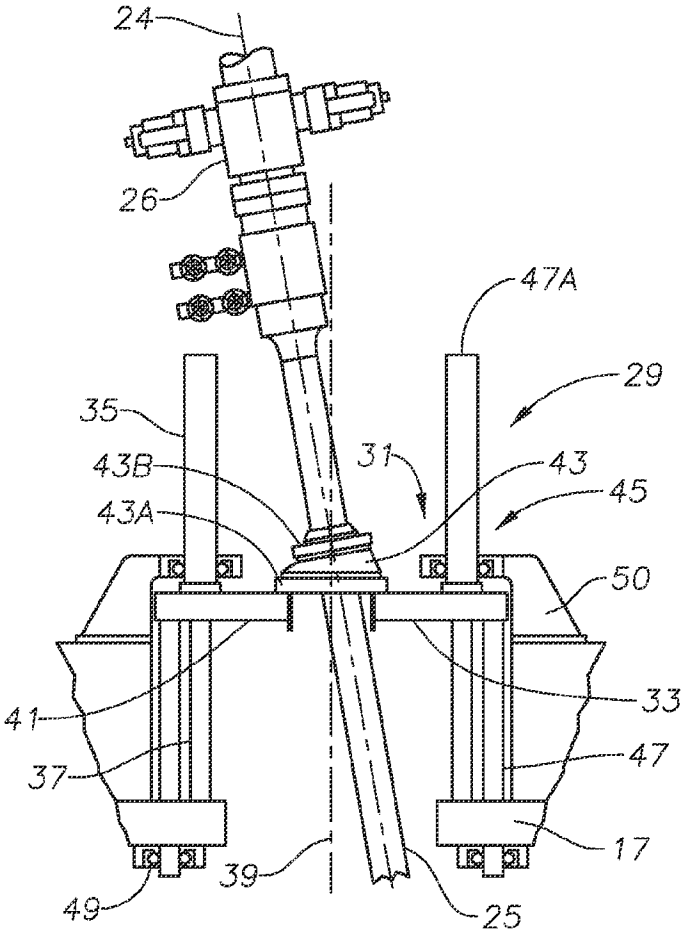
FIG. 7 is an elevation view of a riser tensioner assembly in accordance with another embodiment of the present disclosure, with the support frame shown in a raised position and the riser shown in an angled position.

Turning now to the embodiment of FIGS. 7-8, one guide rod 47 is secured to a lower side, and extends downward from, support frame 33. Piston cylinder 35 acts as a second guide rod 47A and is secured to and extends upwards from support frame 33. Guide element support 50 is secured to deck 17, with one set of guide elements 49 being located above support frame 33 for engaging piston cylinder 35. The second set of guide elements 49 is located below deck 17 for engaging guide rod 47 that extends downward from support frame 33.

In an example of operation, with the first section of hydro-pneumatic assembly 31 secured to deck 17 proximate to the opening through deck 17, and the second section of hydro-pneumatic assembly 31 secured to support frame 33, riser 25 can be coupled to support frame 33 with pivot joint 43. Pivot joint 43 is sized to prevent relative translational movement between riser 25 and support frame 33. As floating platform 11 moves, the relative axial movement between support frame 33 and deck 17 can be guided with guide assembly 45 and hydro-pneumatic assembly 31 will continue to apply an upward force on support frame 33 in the direction of central axis 39, urging support frame 33 upwards and away from deck 17. Guide rod 47 and guide elements 49 of guide assembly 45 will resist relative rotation between support frame 33 and deck 17. This results in support frame 33 being maintained in an orientation generally parallel to deck 17 as support frame 33 moves between raised positions and lowered positions. As floating platform 11 moves, pivot joint 43 transfers loads between riser 25 and support frame 33 while allowing angular offset between riser 25 and support frame 33.

Accordingly, the disclosed embodiments provide numerous advantages over prior art riser tensioners. Embodiments of this disclosure provide the technical advantages of the push up type tensioner system with a system and method with scalable components. For example, support frame 33, hydro-pneumatic assembly 31 and guide assembly 45 can be sized to accommodate the design loads and stroke lengths for a particular floating platform 11 in a particular environment with scalable costs. This will result in a lower cost system for tension leg platforms with lower design loads and stroke lengths, making the push up systems and methods of this disclosure economically feasible for such design conditions.

It is understood that the present disclosure may take many forms and embodiments. Accordingly, several variations may be made in the foregoing without departing from the spirit or scope of the disclosure. Having thus described the present disclosure by reference to certain of its preferred embodiments, it is noted that the embodiments disclosed are illustrative rather than limiting in nature and that a wide range of variations, modifications, changes, and substitutions are contemplated in the foregoing disclosure and, in some instances, some features of the present disclosure may be employed without a corresponding use of the other features. Many such variations and modifications may be considered obvious and desirable by those skilled in the art based upon a review of the foregoing description of preferred embodiments. Accordingly, it is appropriate that the appended claims be construed broadly and in a manner consistent with the scope of the disclosure.

What is claimed is:

1. A tensioner for maintaining a tensile force in a riser extending from a subsea wellhead assembly to a deck of a floating platform, the tensioner comprising:

a hydro-pneumatic assembly having a first section configured to be secured to the deck and a second section secured to a support frame located above the deck, the support frame having an upper opening with a central axis through which the riser is adapted to extend;

a pivot joint adapted to be coupled to the riser and coupled to the support frame at the upper opening so that the riser is retained axially static with respect to the support frame and is pivotable with respect to the support frame;

at least one guide rod radially spaced from and parallel to the axis;

a guide assembly having at least two guide elements, the guide elements being axially spaced from each other so that when the deck and the support frame move axially relative to each other, the guide assembly restricts relative pivotal rotational movement between the deck and the support frame; and wherein the first section of the hydro-pneumatic assembly extends downward from the deck and has a lower end that defines a lower opening through which the axis passes, the lower opening having a greater cross-sectional area than the upper opening to enable pivotal movement of the riser relative to the support frame.

2. The tensioner of claim 1, wherein the deck has an intermediate opening through which the axis passes, the intermediate opening being below the upper opening and above the lower opening, the intermediate opening having a greater cross-sectional area than the upper opening.

3. The tensioner of claim 1, wherein the guide rod is mounted to and moves axially with the support frame relative to the deck.

4. The tensioner of claim 3, wherein the guide rod extends downward from the support frame, and both of the guide elements are mounted to and axially fixed with the deck.

5. The tensioner of claim 1, wherein:

the guide assembly further comprises a guide element support mounted to and extending downward from a lower side of the deck, the guide elements being mounted to the guide element support: and wherein the guide rod is mounted to the support frame for axial movement in unison relative to the deck, the guide rod extending downward from the support frame through the deck and both of the guide elements.

6. The tensioner of claim 1, wherein the guide assembly further comprises:

a guide element support mounted to the support frame for axil movement in unison relative to the deck, both of the guide elements being mounted to the guide element support; and wherein the guide rod id mounted to and axially fixed with the deck and extends upward from the deck through both of the guide elements.

7. The tensioner of claim 1, further comprising:

a guide element support mounted to and extending upward from the deck above the support frame; wherein an upper one of the guide elements is mounted to and axially fixed with the guide element support above the support frame;

a lower one of the guide elements is mounted to and fixed with the deck;

the guide rod is mounted to and axially movable with the support frame relative to the deck, the guide rod extending downward from the guide frame through the lower one of the guide elements, and the second section of the hydro-pneumatic assembly extends upward from the deck through the upper one of the guide elements.

8. The tensioner of claim 1, wherein the guide assembly further comprises:

a tubular guide element support mounted to and extending downward from the deck;

both of the elements are mounted within the guide element support below the deck; and wherein the guide rod is mounted to the support frame for axial movement in unison with the support frame relative to the deck, the guide rod extending downward from the support frame through the guide element support and both of the guide elements.

9. The tensioner of claim 1, wherein the guide assembly further comprises:

a tubular guide element support mounted to the support frame for axial movement in unison relative to the deck, both the guide elements being mounted within the guide element support, with one of the guide elements above the support frame and the other beloww the support frame; and wherein the guide rod is mounted to and axially fixed with the deck and extends upward from the deck through the guide element support and both of the guide elements.

10. The tensioner of claim 1, wherein the second section of the hydro-pneumatic assembly extends through one of the guide elements and is axially movable relative to said one of the guide elements.

11. A tensioner for maintaining a tensile force in a riser extending from a subsea wellhead assembly to a deck of a floating platform, the tensioner comprising:

a support frame with a central axis spaced axially away from, and configured to be generally parallel to the deck;

a hydro-pneumatic assembly having a first section configured to be secured to the deck and a second section secured to the support frame, the hydro-pneumatic assembly urging the support frame away from the deck;

a pivot joint adapted to be coupled to the riser and coupled to the support frame so that the riser is retained axially static with respect to the support frame and is pivotable with respect to the support frame;

a guide rod mounted to and axially movable with the support frame, the guide rod extending downward from the support frame through the deck, the guide rod being parallel to and radially spaced from the axis;

at least two guide elements axially fixed with deck, the guide elements being axially spaced from each other; and the guide rod extending through at least one of the guide elements.

12. The tensioner of claim 11, wherein both of the guide elements are mounted below the deck; and the guide rod extends through both of the guide elements.

13. The tensioner of claim 11, further comprising:

a tubular guide element support axially fixed with and extending downward from the deck; wherein both of the guide elements are mounted within the guide element support below the deck; and the guide rod extends through the guide element support and both of the guide elements.

14. The tensioner of claim 11, wherein:

a lower one of the guide elements is mounted below the deck;

an upper one of the guide elements is mounted above the deck and above the support frame;

the guide rod extends through the lower one of the guide elements; and the second section of the hydro-pneumatic assembly extends through the upper one of the guide elements.

15. A tensioner for maintaining a tensile force in a riser extending from a subsea wellhead assembly to a deck of a floating platform, the tensioner comprising:

a support frame with a central axis spaced axially away from, and configured to be generally parallel to and above the deck;

a hydro-pneumatic assembly having a first section configured to be secured to the deck and a second section secured to the support frame, the hydro-pneumatic assembly urging the support frame away from the deck;

a pivot joint adapted to be coupled to the riser and coupled to the support frame so that the riser is retained axially static with respect to the support frame and is pivotable with respect to the support frame;

a guide rod mounted to and axially fixed with the deck, the guide rod extending upward from the deck through the support frame, the guide rod being parallel to and radialy spaced from the axis;

an upper guide element axially fixed with and located above the support frame ;

a lower guide element axially fixed with and located below the support frame; and wherein the guide rod extends through and is axially movable relative to both of the guide elements.

* * * * *